US009514921B2

(12) United States Patent
Bloomfield et al.

(10) Patent No.: US 9,514,921 B2
(45) Date of Patent: Dec. 6, 2016

(54) INTENSITY CORRECTION FOR TOF DATA ACQUISITION

(71) Applicant: DH Technologies Development Pte. Ltd., Singapore (SG)

(72) Inventors: Nic G. Bloomfield, Newmarket (CA); Alexandre V. Loboda, Thornhill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/907,447

(22) PCT Filed: Aug. 7, 2014

(86) PCT No.: PCT/IB2014/001473
§ 371 (c)(1),
(2) Date: Jan. 25, 2016

(87) PCT Pub. No.: WO2015/019161
PCT Pub. Date: Feb. 12, 2015

(65) Prior Publication Data

US 2016/0189943 A1 Jun. 30, 2016

Related U.S. Application Data

(60) Provisional application No. 61/863,942, filed on Aug. 9, 2013.

(51) Int. Cl.
*H01J 49/40* (2006.01)
*H01J 49/42* (2006.01)
(Continued)

(52) U.S. Cl.
CPC ..... *H01J 49/0009* (2013.01); *H01J 49/025* (2013.01); *H01J 49/40* (2013.01)

(58) Field of Classification Search
CPC ..... H01J 49/0036; H01J 49/025; H01J 49/40; H01J 49/02; H01J 49/26; H01J 49/0009; H01J 49/0031; H01J 49/4215; G06F 19/703; G06K 9/00496
(Continued)

(56) References Cited

U.S. PATENT DOCUMENTS 7,084,393 B2 * 8/2006 Fuhrer ..... H01J 49/0036 250/283
7,365,313 B2 * 4/2008 Fuhrer ..... H01J 49/0036 250/281
(Continued)

FOREIGN PATENT DOCUMENTS

WO 2012080443 A1 6/2012
WO 2012095648 A1 7/2012

OTHER PUBLICATIONS

International Search Report and Written Opinion for PCT/IB2014/001473, mailed Dec. 22, 2014.

*Primary Examiner* — David A Vanore
(74) *Attorney, Agent, or Firm* — John R. Kasha; Kelly L. Kasha; Kasha Law LLC

(57) ABSTRACT

Systems and methods are provided for correcting uniform detector saturation. In one method, a mass analyzer analyzes N extractions of an ion beam. A nonzero amplitude from an ADC detector subsystem is counted as one ion, producing a count of one for each ion of each sub-spectrum. The ADC amplitudes and counts of the N sub-spectra are summed, producing a spectrum that includes a summed ADC amplitude and a total count for each ion of the spectrum. A probability that the total count arises from single ions hitting the detector is calculated. For each ion of the spectrum where the probability exceeds a threshold value, an amplitude response is calculated, producing amplitude responses for ions found to be single ions hitting the detector. Amplitude responses are combined, producing a combined amplitude response. The total count is dynamically corrected using the combined amplitude response and the summed ADC amplitude.

15 Claims, 7 Drawing Sheets

(51) Int. Cl.
*H01J 49/00* (2006.01)
*H01J 49/02* (2006.01)

(58) Field of Classification Search
USPC .. 250/281, 282, 283, 286, 287, 288; 702/22, 28, 32
See application file for complete search history.

(56) References Cited

U.S. PATENT DOCUMENTS 8,178,834 B2 * 5/2012 Gorenstein ..... G06F 19/703 250/281
8,480,110 B2 * 7/2013 Gorenstein ..... G06F 19/703 250/281
8,492,710 B2 * 7/2013 Fuhrer ..... H01J 49/0036 250/281
9,404,955 B2 * 8/2016 Green ..... G01R 29/26
2004/0149900 A1 8/2004 Makarov et al.
2011/0186727 A1 8/2011 Loboda
2012/0228488 A1 * 9/2012 Decker ..... H01J 49/0036 250/282
2012/0259557 A1 * 10/2012 Gorenstein ..... G06F 19/703 702/32
2013/0119249 A1 5/2013 Niehuis
2016/0148791 A1 * 5/2016 Bloomfield ..... H01J 49/025 702/104
2016/0181076 A1 * 6/2016 Smith ..... H01J 49/4215 702/104

* cited by examiner

100

INTENSITY CORRECTION FOR TOF DATA ACQUISITION

CROSS REFERENCE TO RELATED APPLICATION

This application claims the benefit of U.S. Provisional Patent Application Ser. No. 61/863,942, filed Aug. 9, 2013, the content of which is incorporated by reference herein in its entirety.

INTRODUCTION

When the spectra of a time-of-flight (TOF) mass analyzer are recorded with an analog-to-digital converter (ADC) detector subsystem, the number of ions in a peak is calculated from the peak signal using a value that relates to the average amplitude of electrical response to a single ion, for example. This method works well up to a certain point. As the total ion flux arriving at the detector increases, however, the value of the average detector response to an individual ion starts to decline, or saturate. In other words, as more and more ions hit the detector and the total charge on the detector exceeds a certain threshold level, the detector starts to uniformly suppress amplitudes. This type of saturation is referred to herein as uniform detector saturation.

SUMMARY

A system is disclosed for dynamically correcting uniform detector saturation of a mass analyzer. The system includes an ion source, a mass analyzer, and a processor. The mass analyzer includes a detector and ADC detector subsystem. The mass analyzer analyzes a beam of ions produced by the ion source that ionizes sample molecules.

The processor instructs the mass analyzer to analyze N extractions of the ion beam, producing N sub-spectra. For each sub-spectrum of the N sub-spectra, the processor counts a nonzero amplitude from the ADC detector subsystem as one ion, producing a count of one for each ion of each sub-spectrum of the N sub-spectra. The processor sums the ADC amplitudes and counts of the N sub-spectra, producing a spectrum that includes a summed ADC amplitude and a total count for each ion of the spectrum. For each ion of the spectrum, the processor calculates a probability that the total count arises from single ions hitting the detector using Poisson statistics.

For each ion of the spectrum where the probability exceeds a threshold value, the processor calculates an amplitude response by dividing the summed ADC amplitude by the total count, producing one or more amplitude responses for one or more ions found to be single ions hitting the detector. The processor combines the one or more amplitude responses, producing a combined amplitude response that expresses the amount of ADC amplitude produced by a single ion. For each ion of the spectrum, the processor dynamically corrects the total count using the combined amplitude response and the summed ADC amplitude.

A method is disclosed for dynamically correcting uniform detector saturation of a mass analyzer. A TOF mass analyzer that includes a detector and an ADC detector subsystem is instructed to analyze N extractions of the ion beam using a processor, producing N sub-spectra. For each sub-spectrum of the N sub-spectra, a nonzero amplitude from the ADC detector subsystem is counted as one ion using the processor, producing a count of one for each ion of each sub-spectrum of the N sub-spectra. The ADC amplitudes and counts of the N sub-spectra are summed using the processor, producing a spectrum that includes a summed ADC amplitude and a total count for each ion of the spectrum. For each ion of the spectrum, a probability that the total count arises from single ions hitting the detector is calculated using Poisson statistics using the processor.

For each ion of the spectrum where the probability exceeds a threshold value, an amplitude response is calculated by dividing the summed ADC amplitude by the total count using the processor, producing one or more amplitude responses for one or more ions found to be single ions hitting the detector. The one or more amplitude responses are combined using the processor, producing a combined amplitude response that expresses the amount of ADC amplitude produced by a single ion. For each ion of the spectrum, the total count is dynamically corrected using the combined amplitude response and the summed ADC amplitude using the processor.

A computer program product is disclosed that includes a non-transitory and tangible computer-readable storage medium whose contents include a program with instructions being executed on a processor so as to perform a method for dynamically correcting uniform detector saturation of a mass analyzer. In various embodiments, the method includes providing a system, wherein the system comprises one or more distinct software modules, and wherein the distinct software modules comprise a control module and an analysis module.

The control module instructs a mass analyzer that includes a detector and an ADC detector subsystem and that analyzes a beam of ions to analyze N extractions of the ion beam using the control module, producing N sub-spectra. For each sub-spectrum of the N sub-spectra, the analysis module counts a nonzero amplitude from the ADC detector subsystem as one ion, producing a count of one for each ion of each sub-spectrum of the N sub-spectra. The analysis module sums the ADC amplitudes and counts of the N sub-spectra, producing a spectrum that includes a summed ADC amplitude and a total count for each ion of the spectrum. For each ion of the spectrum, the analysis module calculates a probability that the total count arises from single ions hitting the detector using Poisson statistics.

For each ion of the spectrum where the probability exceeds a threshold value, the analysis module calculates an amplitude response by dividing the summed ADC amplitude by the total count, producing one or more amplitude responses for one or more ions found to be single ions hitting the detector. The analysis module combines the one or more amplitude responses, producing a combined amplitude response that expresses the amount of ADC amplitude produced by a single ion. For each ion of the spectrum, the analysis module dynamically corrects the total count using the combined amplitude response and the summed ADC amplitude.

A system is disclosed for correcting uniform detector saturation of a mass analyzer using a calibration curve. The system includes an ion source that ionizes molecules of sample producing a beam of ions, and a mass analyzer that includes a detector and an ADC detector subsystem analyzes the beam of ions, producing a measured spectrum. The system further includes a processor in communication with the mass analyzer that receives the measured spectrum from the mass analyzer. The processor further calculates a total ion value of the measured spectrum by summing intensities of ions in the measured spectrum. The processor further determines a correction factor by comparing the total ion value to a stored calibration curve that provides correction factors as a function of total ion values. The processor further multiplies intensities of the measured spectrum by the determined correction factor producing a corrected measured spectrum.

A method is disclosed for correcting uniform detector saturation of a mass analyzer using a calibration curve. A measured spectrum is received from a mass analyzer that includes a detector and an ADC detector subsystem and that analyzes a beam of ions produced by an ion source that ionizes molecules of a sample using a processor. A total ion value of the measured spectrum is calculated by summing intensities of ions in the measured spectrum using the processor. A correction factor is determined by comparing the total ion value to a stored calibration curve that provides correction factors as a function of total ion values using the processor. Intensities of the measured spectrum are multiplied by the determined correction factor producing a corrected measured spectrum using the processor.

A computer program product is disclosed that includes a non-transitory and tangible computer-readable storage medium whose contents include a program with instructions being executed on a processor so as to perform a method for correcting uniform detector saturation of a mass analyzer using a calibration curve. In various embodiments, the method includes providing a system, wherein the system comprises one or more distinct software modules, and wherein the distinct software modules comprise a control module and an analysis module.

The control module receives a measured spectrum from a mass analyzer that includes a detector and an ADC detector subsystem and that analyzes a beam of ions produced by an ion source that ionizes molecules of a sample. The analysis module calculates a total ion value of the measured spectrum by summing intensities of ions in the measured spectrum. The analysis module determines a correction factor by comparing the total ion value to a stored calibration curve that provides correction factors as a function of total ion values. The analysis module multiplies intensities of the measured spectrum by the determined correction factor producing a corrected measured spectrum.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
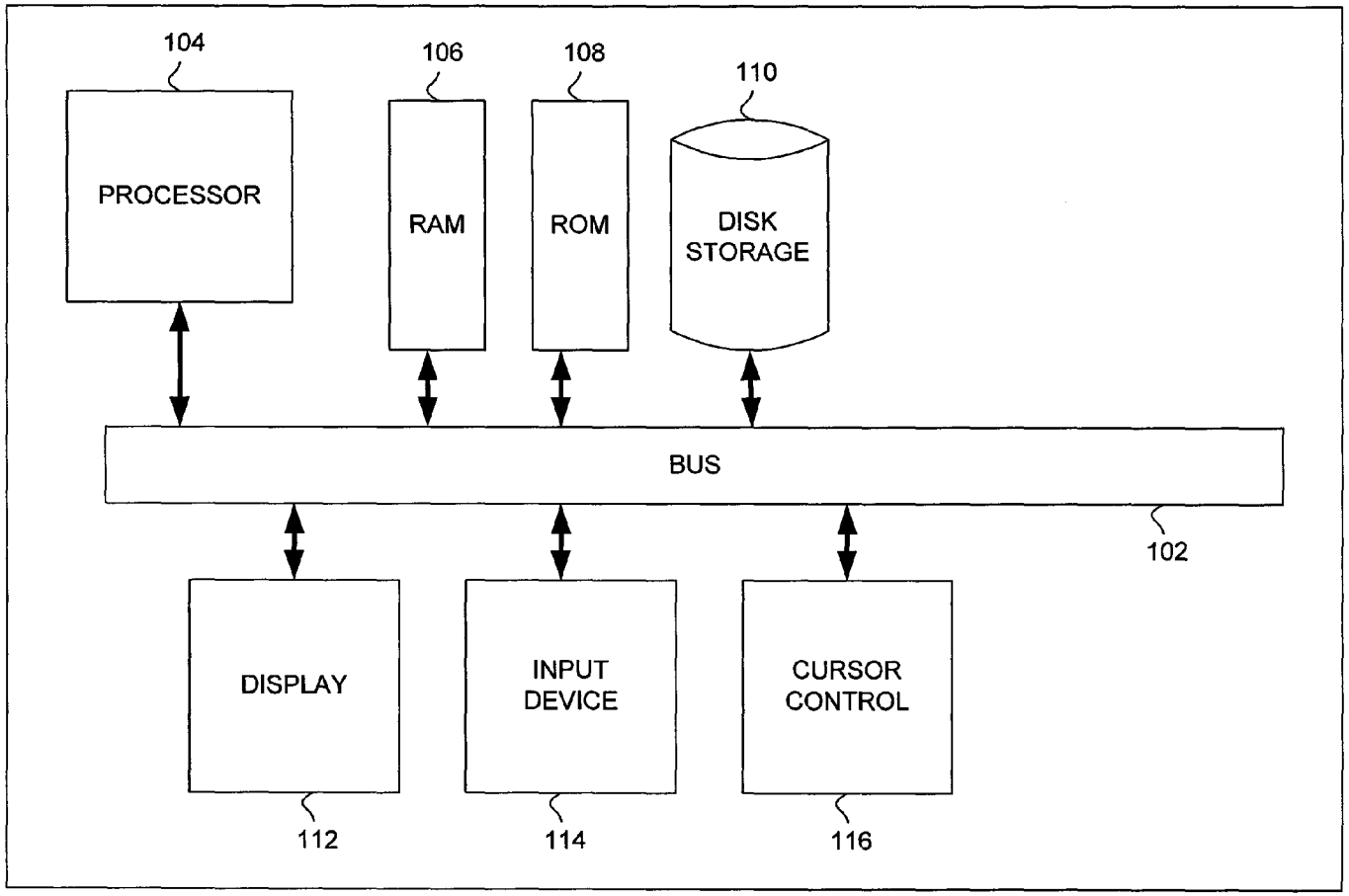
FIG. 1 is a block diagram that illustrates a computer system, in accordance with various embodiments.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, in accordance with various embodiments. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for TOF Intensity Correction

As described above, when the spectra of a time-of-flight (TOF) mass analyzer are recorded with an analog-to-digital converter (ADC) detector subsystem, the number of ions in a peak is calculated from the peak amplitude. However, as more and more ions hit the detector, and the total charge on the detector exceeds a certain threshold level, the detector starts to uniformly suppress amplitudes. This type of saturation is referred to herein as uniform detector saturation.

In various embodiments, uniform detector saturation is corrected by calculating a correction factor from a calibration experiment. A correction factor is a property of a particular detector, for example. A correction factor is calculated for each given ion flux. The correction factor is multiplied by each measured ion intensity at a given detector load.

If it is assumed, for example, that the correction factor depends solely on the average current flowing through the detector under a particular ion flux, uniform detector saturation can be corrected using a method based on the following steps. Detector signals are measured. Using these detector signals, the total detector current consumed for the recording of the ion flux is calculated. Then, the correction factor is determined from the value of the total detector current. Finally, the correction factor is applied to the measured detector flux to give a more accurate calculation of the incoming ion flux.

The correction factor is determined from the value of the total detector current using a calibration function, for example. The calibration function for a given detector is obtained by a detector calibration procedure in which incoming ion current is varied in a known manner and the detector output signal is recorded. This function can, for example, be generic enough so that it can be used across many detectors of the same type.

More specifically, a calibration experiment is run for a given detector at a given tuning voltage. The amplitude of a known peak is recorded to determine how it decreases as the total charge on the detector increases. A curve is plotted from the recorded amplitudes, and coefficients are selected for a quadratic equation that is fit to the curve. At run time, the quadratic equation is then applied to all of the amplitudes measured to correct for uniform detector saturation.

In this embodiment, however, a calibration experiment needs to be performed each time the detector is tuned.

In various alternative embodiments, the potential for errors in the saturation correction is reduced significantly by constantly calculating the saturation correction factor dynamically during data acquisition. This method involves monitoring in real-time a low intensity or background ion during data acquisition. By monitoring a low intensity or background ion, it is possible to calculate an amplitude response for a single low intensity ion or background ion relative to the number of ions collected. As a result, a ratio of the response of a single ion to the number of ions collected is constantly calculated.

A key aspect of various embodiments is determining that a ratio of the response to the number of ions is for a single ion. This is determined by simultaneously recording an equivalent of a time-to-digital (TDC) response with every ADC response. From the TDC equivalent response, a Poisson distribution is used to determine the probability that the response is produced by one ion. If the probability is above a certain threshold, then the response is considered to be from a single ion hitting the detector at any one time, and the ratio of the response to the number of ions for that single ion is used in calculating the correction factor.

Figure 2:
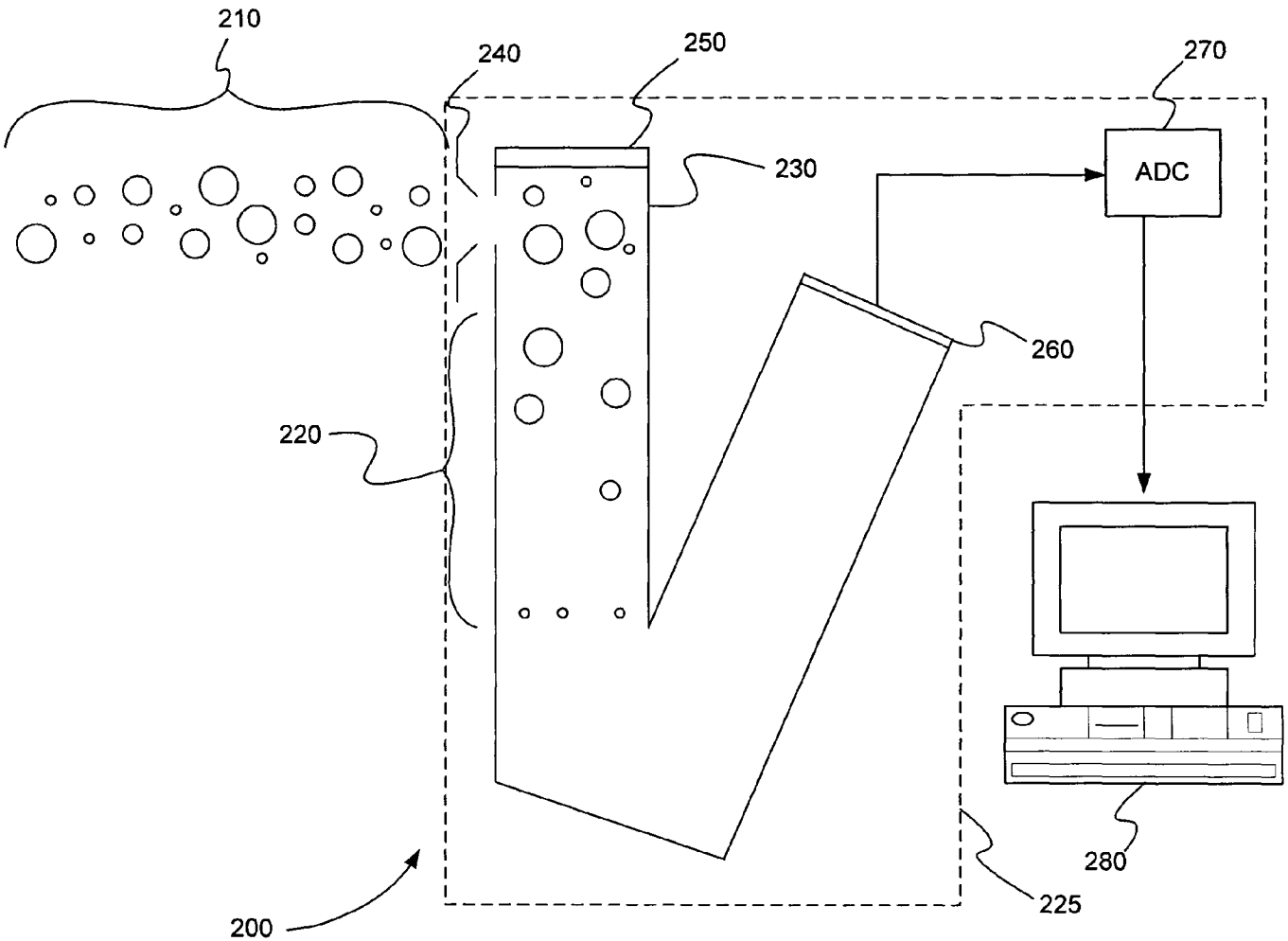
FIG. 2 is an exemplary diagram of a time-of-flight (TOF) mass spectrometry system showing ions entering a TOF tube, in accordance with various embodiments.

FIG. 2 is an exemplary diagram of a time-of-flight (TOF) mass spectrometry system 200 showing ions 210 entering TOF tube 230, in accordance with various embodiments. TOF mass spectrometry system 200 includes TOF mass analyzer 225 and processor 280. TOF mass analyzer 225 includes TOF tube 230, skimmer 240, extraction device 250, ion detector 260, and ADC detector subsystem 270. Skimmer 240 controls the number of ions entering TOF tube 230. Ions 210 are moving from an ion source (not shown) to TOF tube 230. The number of ions entering TOF tube 230 can be controlled by pulsing skimmer 240, for example.

Extraction device 250 imparts a constant energy to the ions that have entered TOF tube 230 through skimmer 240. Extraction device 250 imparts this constant energy by applying a fixed voltage at a fixed frequency, producing a series of extraction pulses, for example. Because each ion receives the same energy from extraction device 250, the velocity of each ion depends on its mass. According to the equation for kinetic energy, velocity is proportional to the inverse square root of the mass. As a result, lighter ions fly through TOF tube 230 much faster than heavier ions. Ions 220 are imparted with a constant energy in a single extraction, but fly through TOF tube 230 at different velocities.

Time is needed between extraction pulses to separate the ions in TOF tube 230 and detect them at ion detector 260. Enough time is allowed between extraction pulses so that the heaviest ion can be detected.

Ion detector 260 generates an electrical detection pulse for every ion that strikes it during an extraction. These detection pulses are passed to ADC detector subsystem 270, which records the amplitudes of the detected pulses digitally. In a TDC detector subsystem, for example, ADC detector subsystem 270 is replaced by a constant fraction discriminator (CFD) coupled to a TDC. The CFD removes noise by only transmitting pulses that exceed a threshold value, and the TDC records the time values at which the electrical detection pulses occur.

Processor 280 receives the pulses recorded by ADC detector subsystem 270 during each extraction. Because each extraction may contain only a few ions from a compound of interest, the responses for each extraction can be thought of as a sub-spectrum. In order to produce more useful results, processor 280 can sum the sub-spectra of time values from a number of extractions to produce a full spectrum.

Figure 3:
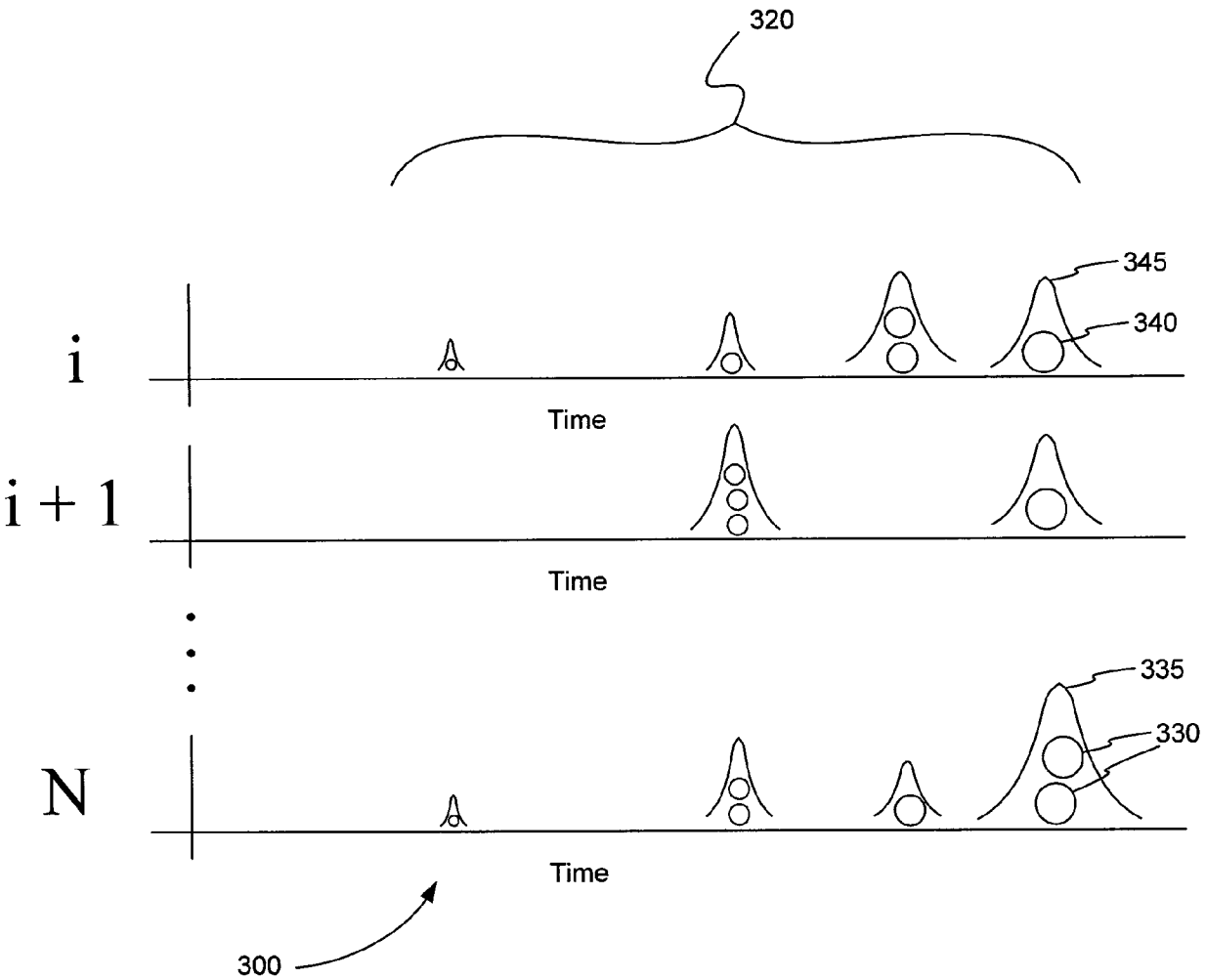
FIG. 3 is a plot of sub-spectra received by the processor of FIG. 2 for a series of N extractions, according to various embodiments.

FIG. 3 is a plot of sub-spectra 300 received by processor 280 of FIG. 2 for a series of N extractions, according to various embodiments. Sub-spectra for extractions i through N include time values for each ion detected. The horizontal position of each ion in each sub-spectrum represents the time it takes that ion to be detected relative to the extraction pulse. Ions 320 of extraction i in FIG. 3 correspond to ions 220 in FIG. 2, for example.

As described above, a key aspect of various embodiments is determining if a ratio of the response to the number of ions is for a single ion. As shown in sub-spectra 300 of FIG. 3, an ADC produces an amplitude response that is dependent on the number of ions hitting the detector at substantially the same time. For example, the two ions 330 in extraction N produce amplitude response 335 that is larger than amplitude response 345, which is produced by a single ion 340 in extraction i. In other words, the response that an ADC produces is proportional to the number of ions hitting the detector at substantially the same time.

A TDC, on the other hand, does not record a signal that is proportional to the number of ions hitting the detector at substantially the same time. Instead, a TDC records only if at least one ion of a particular mass impacted the detector.

TDC information, however, can be determined from ADC information. For example, in sub-spectra 300 of FIG. 3, a processor, such as processor 280 of FIG. 2 can count the impact of the two ions 330 as a single ion hit for extraction N. In other words, for every extraction, in addition to the ADC response, a single hit is recorded for any amplitude response for a given mass. This produces a response equivalent to a TDC response. A ratio of the ADC response to the number of ions is then determined from both the ADC response and the equivalent TDC response.

Figure 4:
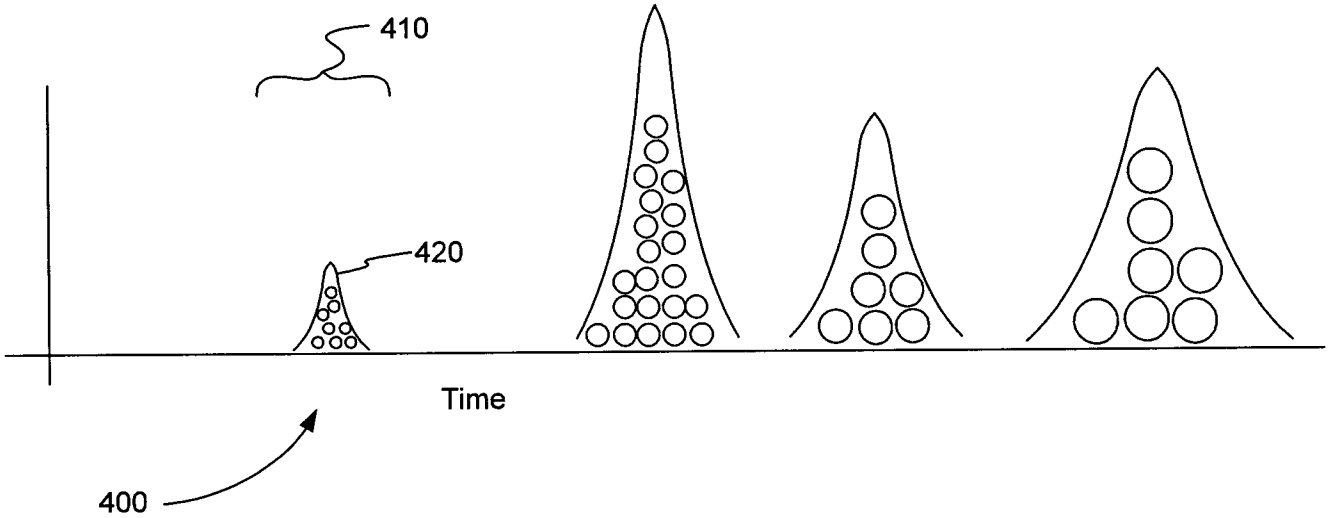
FIG. 4 is a plot of the analog-to-digital converter (ADC) spectrum produced by the processor of FIG. 2 from summing the N sub-spectra of FIG. 3, in accordance with various embodiments.

FIG. 4 is a plot of the ADC spectrum 400 produced by processor 280 of FIG. 2 from summing the N sub-spectra of FIG. 3, in accordance with various embodiments. Spectrum 400 includes ions of four different masses, for example. Suppose ions 410, for one of those four masses, have an equivalent TDC ion count of K for N extractions. The probability, P, that a single ion hits the detector is calculated using a Poisson distribution. The probability P is compared to a threshold probability level.

If P exceeds the threshold level, then there is high confidence that ADC response 420 represents the response for a single ion hitting the detector at any one time. ADC response 420 can then be used to calculate the correction factor. For example, ADC response 420 can be divided by the equivalent TDC ion count, K, to produce the ratio of the ADC response to the number of ions.

System for Dynamically Correcting Uniform Detector Saturation

Returning to FIG. 2, system 200 is an exemplary mass spectrometry system for dynamically correcting uniform detector saturation. As described above, system 200 includes mass analyzer 225 and processor 280. Mass analyzer 225 can be, for example, TOF mass analyzer 225.

Mass analyzer 225 can be coupled to one or more mass spectrometry components (not shown) in system 200. One or more mass spectrometry components can include, but are not limited to, quadrupoles, for example. Mass analyzer 225 can also be coupled to one or more additional mass analyzers.

Mass spectrometry system 200 can also include one or more separation devices (not shown). The separation device can perform a separation technique that includes, but is not limited to, liquid chromatography, gas chromatography, capillary electrophoresis, or ion mobility. Mass analyzer 225 can include separating mass spectrometry stages or steps in space or time, respectively.

Processor 280 can be, but is not limited to, a computer, microprocessor, or any device capable of sending and receiving control signals and data to and from mass analyzer 225 and processing data. Processor 280 is, for example, a computer system such as the computer system shown in FIG. 1. Processor 280 is in communication with mass analyzer 225.

Mass analyzer 225 includes detector 260 and ADC detector subsystem 270. Mass analyzer 225 analyzes a beam of ions 210, for example, produced by an ion source (not shown) that ionizes sample molecules.

Processor 280 instructs mass analyzer 225 to analyze N extractions of the ion beam, producing N sub-spectra. For each sub-spectrum of the N sub-spectra, processor 280 counts a nonzero amplitude from ADC detector subsystem 270 as one ion, producing a count of one for each ion of each sub-spectrum of the N sub-spectra. Processor 280 sums the ADC amplitudes and counts of the N sub-spectra, producing a spectrum that includes a summed ADC amplitude and a total count for each ion of the spectrum. The total count is, for example, a TDC equivalent count. For each ion of the spectrum, processor 280 calculates a probability that the total count arises from single ions hitting detector 260 using Poisson statistics.

For each ion of the spectrum where the probability exceeds a threshold value, processor 280 calculates an amplitude response by dividing the summed ADC amplitude by the total count, producing one or more amplitude responses for one or more ions found to be single ions hitting detector 260. Processor 280 combines the one or more amplitude responses, producing a combined amplitude response that expresses the amount of ADC amplitude produced by a single ion. For each ion of the spectrum, processor 280 dynamically corrects the total count using the combined amplitude response and the summed ADC amplitude.

In various embodiments, processor 280 combines the one or more amplitude responses by calculating an average amplitude response. In various embodiments, the combined amplitude response comprises the average amplitude response.

In various embodiments, processor 280 combines the one or more amplitude responses by calculating a median amplitude response. In various embodiments, the combined amplitude response comprises the median amplitude response.

In various embodiments, in order to exclude less reliable ions, processor 280 further calculates an amplitude response by dividing the summed ADC amplitude by the total count only for each ion of the spectrum where the probability exceeds a threshold value and where the total count exceeds a threshold count, producing one or more amplitude responses for one or more ions found to be single ions hitting detector 260.

In various embodiments, processor 280 further divides the mass range of the spectrum into two or more windows and performs the steps of combining the one or more amplitude responses and dynamically correcting each ion of each window of the two or more windows separately. Dividing the mass range of the spectrum into two or more windows and combining amplitude responses within the two or more windows reduces error in the correction factor caused by changes in the amplitude response as the mass changes.

Returning to FIG. 2, system 200 is an exemplary mass spectrometry system for correcting uniform detector saturation of a mass analyzer using a calibration curve. System 200 includes mass analyzer 225 and processor 280.

Mass analyzer 225 includes detector 260 and ADC detector subsystem 270. Mass analyzer 225 analyzes a beam of ions 210, for example, produced by an ion source (not shown) that ionizes sample molecules.

Processor 280 receives the measured spectrum from mass analyzer 225, and calculates a total ion value of the measured spectrum by summing intensities of ions in the measured spectrum. Processor 280 further determines a correction factor by comparing the total ion value to a stored calibration curve that provides correction factors as a function of total ion values, and multiplies intensities of the measured spectrum by the determined correction factor producing a corrected measured spectrum.

In various embodiments, processor 280 calculates the calibration curve by plotting a curve of correction factors as a function of total ion values, selecting a quadratic equation that is fit to the curve, and storing the quadratic equation as the stored calibration curve.

In various embodiment, the calibration curve is determined by performing the following steps. (a) Molecules of a known sample are ionized, producing a beam of ions using the ion source. (b) A fraction of ions extracted from the beam of ions is analyzed, producing a first mass spectrum using mass analyzer 225. (c) A next fraction of ions extracted from the beam of ions that is increased from the first fraction by a next known amount is analyzed, producing a next mass spectrum using the mass analyzer. (d) The first mass spectrum and the next mass spectrum are compared by processor 280 by, for each next ion in the next mass spectrum, calculating the ratio of next ion intensity to the corresponding first ion intensity in the first mass spectrum producing a plurality of intensity ratios. (e) The plurality of intensity ratios are combined to produce a representative ratio using processor 280. (f) A correction factor is calculated as the ratio of the known amount to the representative ratio using processor 280. (g) Intensities of ions in the next mass spectrum are summed to generate a next total ion value using processor 280. (h) The correction factor and the next total ion value are stored in a calibration curve using processor 280. (i) Steps (c)-(h) are repeated one or more times to complete a calibration curve that provides correction factors as a function of total ion values.

In various embodiments, processor 280 combines the plurality of intensity ratios to produce a representative ratio comprises calculating an average.

In various embodiments, processor 280 combines the plurality of intensity ratios to produce a representative ratio comprises calculating a median.

In various embodiments, processor 280 combines the plurality of intensity ratios to produce a representative ratio comprises calculating an average or median of intensities greater than a threshold.

Method for Dynamically Correcting Uniform Detector Saturation

Figure 5:
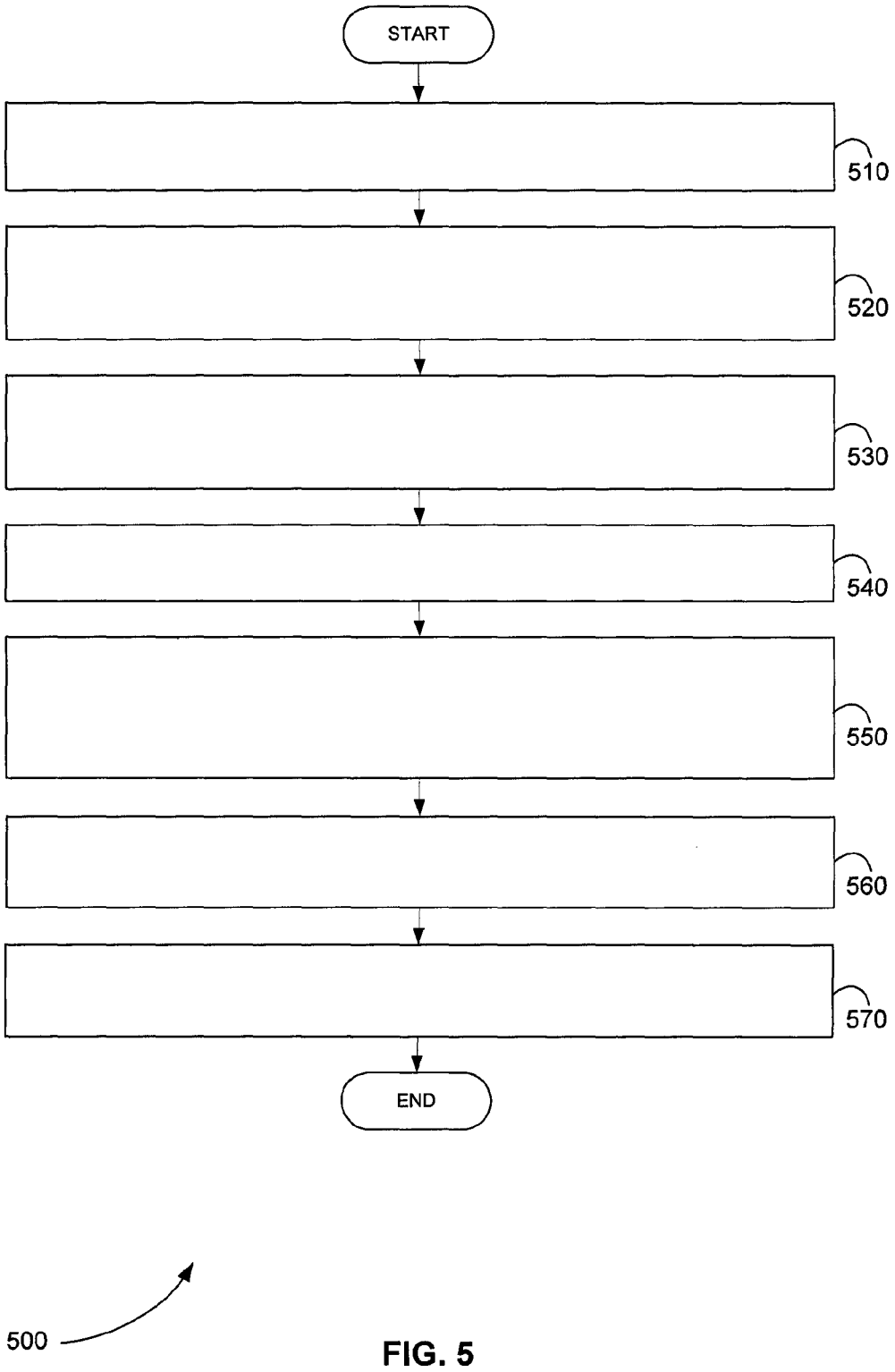
FIG. 5 is an exemplary flowchart showing a method for dynamically correcting uniform detector saturation of a mass analyzer, in accordance with various embodiments.

FIG. 5 is an exemplary flowchart showing a method 500 for dynamically correcting uniform detector saturation of a mass analyzer, in accordance with various embodiments.

In step 510 of method 500, a mass analyzer that includes a detector and an analog-to-digital converter (ADC) detector subsystem is instructed to analyze N extractions of an ion beam using a processor, producing N sub-spectra.

In step 520, for each sub-spectrum of the N sub-spectra, a nonzero amplitude from the ADC detector subsystem is counted as one ion using the processor, producing a count of one for each ion of each sub-spectrum of the N sub-spectra.

In step 530, the ADC amplitudes and counts of the N sub-spectra are summed using the processor, producing a spectrum that includes a summed ADC amplitude and a total count for each ion of the spectrum.

In step 540, for each ion of the spectrum, a probability that the total count arises from single ions hitting the detector is calculated using Poisson statistics using the processor.

In step 550, for each ion of the spectrum where the probability exceeds a threshold value, an amplitude response is calculated by dividing the summed ADC amplitude by the total count using the processor, producing one or more amplitude responses for one or more ions found to be single ions hitting the detector.

In step 560, the one or more amplitude responses are combined using the processor, producing a combined amplitude response that expresses the amount of ADC amplitude produced by a single ion.

In step 570, for each ion of the spectrum, the total count is dynamically corrected using the combined amplitude response and the summed ADC amplitude using the processor.

Figure 6:
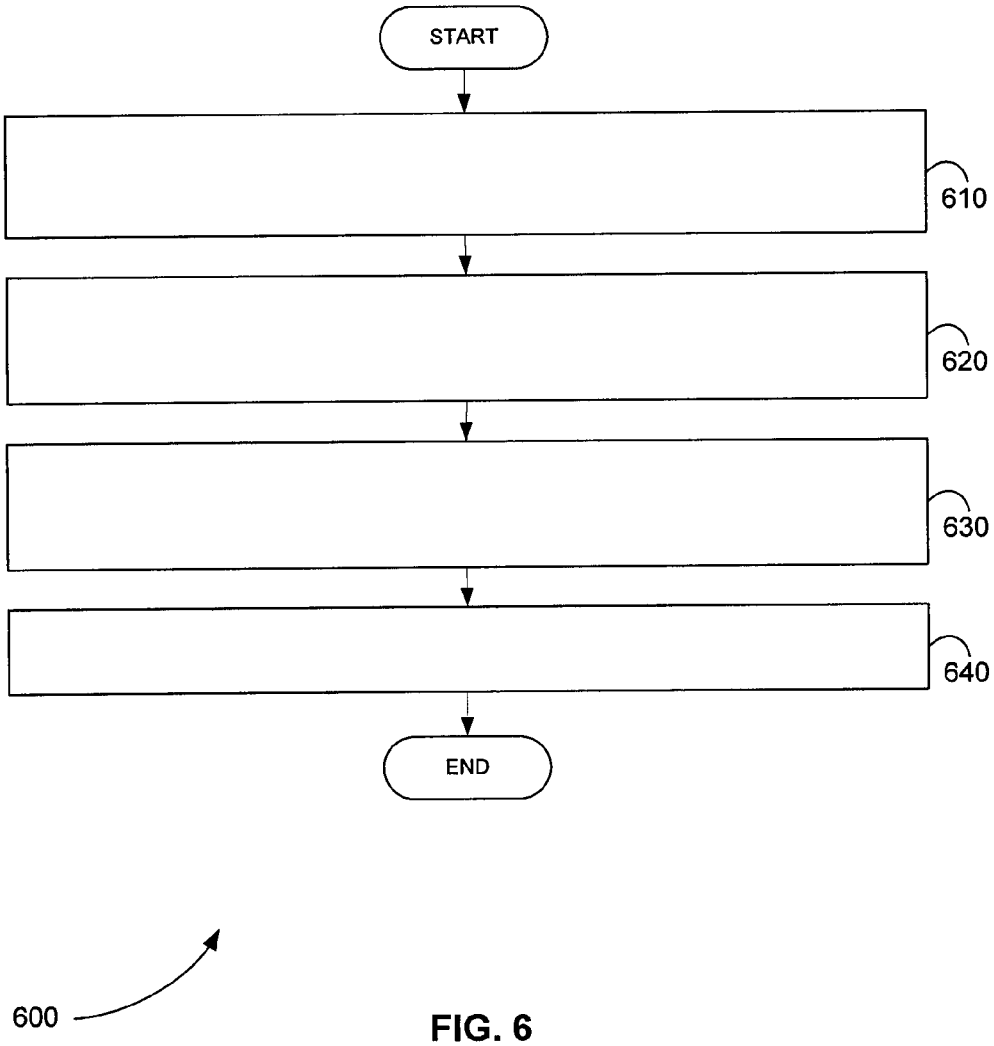
FIG. 6 is an exemplary flowchart showing a method for correcting uniform detector saturation of a mass analyzer using a calibration curve, in accordance with various embodiments.

FIG. 6 is an exemplary flowchart showing a method 600 for correcting uniform detector saturation of a mass analyzer using a calibration curve, in accordance with various embodiments.

In step 610 of method 600, a measured spectrum is received from a mass analyzer that includes a detector and an analog-to-digital converter (ADC) detector subsystem and that analyzes a beam of ions produced by an ion source that ionizes molecules of a sample using a processor.

In step 620, a total ion value of the measured spectrum is calculated by summing intensities of ions in the measured spectrum using the processor.

In step 630, a correction factor is determined by comparing the total ion value to a stored calibration curve that provides correction factors as a function of total ion values using the processor.

In step 640, intensities of the measured spectrum are multiplied by the determined correction factor producing a corrected measured spectrum using the processor.

Computer Program Product for Dynamically Correcting Uniform Detector Saturation

In various embodiments, computer program products include a tangible computer-readable storage medium whose contents include a program with instructions being executed on a processor so as to perform a method for dynamically correcting uniform detector saturation of a mass analyzer. This method is performed by a system that includes one or more distinct software modules.

Figure 7:
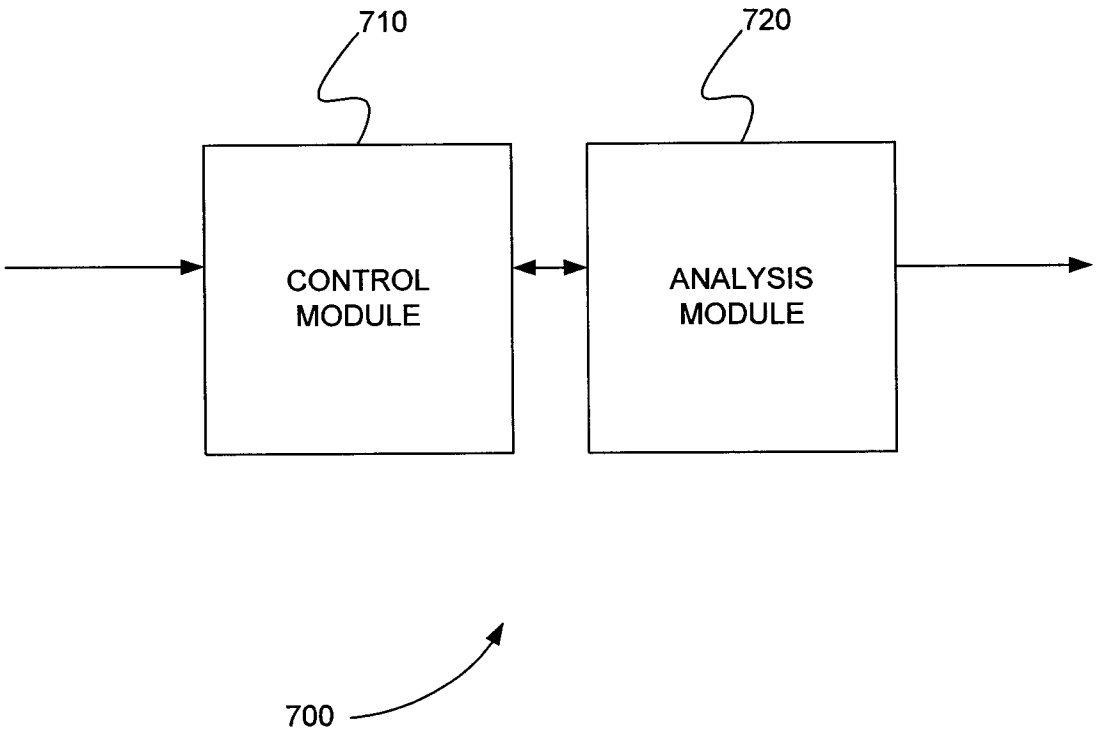
FIG. 7 is a schematic diagram of a system that includes one or more distinct software modules that performs a method for dynamically correcting uniform detector saturation of a TOF mass analyzer, in accordance with various embodiments.

FIG. 7 is a schematic diagram of a system 700 that includes one or more distinct software modules that performs a method for dynamically correcting uniform detector saturation of a mass analyzer, in accordance with various embodiments. System 700 includes control module 710 and analysis module 720.

Control module 710 instructs a mass analyzer that includes a detector and an analog-to-digital converter (ADC) detector subsystem and that analyzes a beam of ions to analyze N extractions of the ion beam using the control module, producing N sub-spectra. For each sub-spectrum of the N sub-spectra, analysis module 720 counts a nonzero amplitude from the ADC detector subsystem as one ion, producing a count of one for each ion of each sub-spectrum of the N sub-spectra. Analysis module 720 sums the ADC amplitudes and counts of the N sub-spectra, producing a spectrum that includes a summed ADC amplitude and a total count for each ion of the spectrum. For each ion of the spectrum, analysis module 620 calculates a probability that the total count arises from single ions hitting the detector using Poisson statistics.

For each ion of the spectrum where the probability exceeds a threshold value, analysis module 720 calculates an amplitude response by dividing the summed ADC amplitude by the total count, producing one or more amplitude responses for one or more ions found to be single ions hitting the detector. Analysis module 720 combines the one or more amplitude responses, producing a combined amplitude response that expresses the amount of ADC amplitude produced by a single ion. For each ion of the spectrum, analysis module 720 dynamically corrects the total count using the combined amplitude response and the summed ADC amplitude.

The one or more distinct software modules of system 700 also perform a method for correcting uniform detector saturation of a mass analyzer using a calibration curve. Control module 710 receives a measured spectrum from a mass analyzer that includes a detector and an analog-to-digital converter (ADC) detector subsystem and that analyzes a beam of ions produced by an ion source that ionizes molecules of a sample. Analysis module 720 calculates a total ion value of the measured spectrum by summing intensities of ions in the measured spectrum, and determines a correction factor by comparing the total ion value to a stored calibration curve that provides correction factors as a function of total ion values. Analysis module 720 further multiplies intensities of the measured spectrum by the determined correction factor producing a corrected measured spectrum.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for dynamically correcting uniform detector saturation of a mass analyzer, comprising:

an ion source that ionizes sample molecules producing a beam of ions; and a mass analyzer that includes a detector and an analog-to-digital converter (ADC) detector subsystem analyzes the beam of ions; and a processor in communication with the mass analyzer that (a) instructs the mass analyzer to analyze N extractions of the ion beam, producing N sub-spectra, (b) for each sub-spectrum of the N sub-spectra, counts a nonzero amplitude from the ADC detector subsystem as one ion, producing a count of one for each ion of each sub-spectrum of the N sub-spectra, (c) sums the ADC amplitudes and counts of the N sub-spectra, producing a spectrum that includes a summed ADC amplitude and a total count for each ion of the spectrum, (d) for each ion of the spectrum, calculates a probability that the total count arises from single ions hitting the detector using Poisson statistics, (e) for each ion of the spectrum where the probability exceeds a threshold value, calculates an amplitude response by dividing the summed ADC amplitude by the total count, producing one or more amplitude responses for one or more ions found to be single ions hitting the detector, (f) combines the one or more amplitude responses, producing a combined amplitude response that expresses the amount of ADC amplitude produced by a single ion, and (g) for each ion of the spectrum, dynamically corrects the total count using the combined amplitude response and the summed ADC amplitude.

2. The system of claim 1, wherein the processor combines the one or more amplitude responses by calculating an average amplitude response and wherein the combined amplitude response comprises the average amplitude response.

3. The system of claim 1, wherein the processor combines the one or more amplitude responses by calculating a median amplitude response and wherein the combined amplitude response comprises the median amplitude response.

4. The system of claim 1, wherein in order to exclude less reliable ions the processor further in step (e) calculates an amplitude response by dividing the summed ADC amplitude by the total count only for each ion of the spectrum where the probability exceeds a threshold value and where the total count exceeds a threshold count, producing one or more amplitude responses for one or more ions found to be single ions hitting the detector.

5. The system of claim 1, wherein the processor further divides the mass range of the spectrum into two or more windows and performs steps (f)-(g) on each window of the two or more windows.

6. A method for dynamically correcting uniform detector saturation of a mass analyzer, comprising:

(a) instructing a mass analyzer that includes a detector and an analog-to-digital converter (ADC) detector subsystem and that analyzes a beam of ions to analyze N extractions of the ion beam using a processor, producing N sub-spectra;

(b) for each sub-spectrum of the N sub-spectra, counting a nonzero amplitude from the ADC detector subsystem as one ion using the processor, producing a count of one for each ion of each sub-spectrum of the N sub-spectra;

(c) summing the ADC amplitudes and counts of the N sub-spectra using the processor, producing a spectrum that includes a summed ADC amplitude and a total count for each ion of the spectrum;

(d) for each ion of the spectrum, calculating a probability that the total count arises from single ions hitting the detector using Poisson statistics using the processor;

(e) for each ion of the spectrum where the probability exceeds a threshold value, calculating an amplitude response by dividing the summed ADC amplitude by the total count using the processor, producing one or more amplitude responses for one or more ions found to be single ions hitting the detector;

(f) combining the one or more amplitude responses using the processor, producing a combined amplitude response that expresses the amount of ADC amplitude produced by a single ion; and (g) for each ion of the spectrum, dynamically correcting the total count using the combined amplitude response and the summed ADC amplitude using the processor.

7. The method of claim 6, further comprising combining the one or more amplitude responses by calculating an average amplitude response using the processor, wherein the combined amplitude response comprises the average amplitude response.

8. The method of claim 6, combining the one or more amplitude responses by calculating a median amplitude response using the processor, wherein the combined amplitude response comprises the median amplitude response.

9. The method of claim 6, wherein in order to exclude less reliable ions, step (e) further comprises calculating an amplitude response by dividing the summed ADC amplitude by the total count only for each ion of the spectrum where the probability exceeds a threshold value and where the total count exceeds a threshold count using the processor, producing one or more amplitude responses for one or more ions found to be single ions hitting the detector.

10. The method of claim 6, wherein the processor further divides the mass range of the spectrum into two or more windows and performs steps (f)-(g) on each window of the two or more windows.

11. A computer program product, comprising a non-transitory and tangible computer-readable storage medium whose contents include a program with instructions being executed on a processor so as to perform a method for dynamically correcting uniform detector saturation of a mass analyzer, the method comprising:

(a) providing a system, wherein the system comprises one or more distinct software modules, and wherein the distinct software modules comprise a control module and an analysis module;

(b) instructing a mass analyzer that includes a detector and an analog-to-digital converter (ADC) detector subsystem and that analyzes a beam of ions to analyze N extractions of the ion beam using the control module, producing N sub-spectra;

(c) for each sub-spectrum of the N sub-spectra, counting a nonzero amplitude from the ADC detector subsystem as one ion using the analysis module, producing a count of one for each ion of each sub-spectrum of the N sub-spectra;

(d) summing the ADC amplitudes and counts of the N sub-spectra using the analysis module, producing a spectrum that includes a summed ADC amplitude and a total count for each ion of the spectrum;

(e) for each ion of the spectrum, calculating a probability that the total count arises from single ions hitting the detector using Poisson statistics using the analysis module;

(f) for each ion of the spectrum where the probability exceeds a threshold value, calculating an amplitude response by dividing the summed ADC amplitude by the total count using the analysis module, producing one or more amplitude responses for one or more ions found to be single ions hitting the detector;

(g) combining the one or more amplitude responses using the analysis module, producing a combined amplitude response that expresses the amount of ADC amplitude produced by a single ion; and (h) for each ion of the spectrum, dynamically correcting the total count using the combined amplitude response and the summed ADC amplitude using the analysis module.

12. The computer program product of claim 11, wherein the method further comprises combining the one or more amplitude responses by calculating an average amplitude response using the processor, wherein the combined amplitude response comprises the average amplitude response.

13. The computer program product of claim 11, wherein the method further comprises combining the one or more amplitude responses by calculating a median amplitude response using the processor, wherein the combined amplitude response comprises the median amplitude response.

14. The computer program product of claim 11, wherein in order to exclude less reliable ions, step (e) of the method further comprises calculating an amplitude response by dividing the summed ADC amplitude by the total count only for each ion of the spectrum where the probability exceeds a threshold value and where the total count exceeds a threshold count using the processor, producing one or more amplitude responses for one or more ions found to be single ions hitting the detector.

15. The computer program product of claim 11, wherein the method further divides the mass range of the spectrum into two or more windows and performs steps (f)-(g) on each window of the two or more windows.

* * * * *